US005413391A

United States Patent [19]

Clavin et al.

[11] Patent Number: 5,413,391

[45] Date of Patent: May 9, 1995

[54] SELF-CLOSING LATCH

[75] Inventors: Timothy J. Clavin, Placentia; John P. Anderson, Norco, both of Calif.

[73] Assignee: Hartwell Corporation, Placentia, Calif.

[21] Appl. No.: 89,343

[22] Filed: Jul. 12, 1993

[51] Int. Cl.[6] ..... E05C 1/12

[52] U.S. Cl. ..... 292/170; 292/244; 292/DIG. 31

[58] Field of Search ..... 292/245, 165, 170, 244, 292/242, 336.5, DIG. 31

[56] References Cited

U.S. PATENT DOCUMENTS

| | | | |
|---|---|---|---|
| 2,900,204 | 8/1959 | Pelcin . | |
| 3,017,760 | 1/1962 | Jones | 292/244 X |
| 3,495,862 | 2/1970 | McClintock . | |
| 3,698,215 | 10/1972 | Truhon . | |
| 3,707,862 | 1/1973 | Pastva, Jr. | 292/DIG. 31 X |
| 4,335,595 | 6/1982 | Swan et al. | 292/DIG. 31 X |
| 4,676,081 | 6/1987 | Craig | 292/DIG. 31 X |
| 4,683,736 | 8/1987 | Weinerman et al. | 292/165 X |
| 4,841,755 | 6/1989 | Weinerman et al. | 292/227 |
| 4,882,919 | 11/1989 | Craig | 292/165 X |
| 4,892,338 | 1/1990 | Weinerman et al. | 292/DIG. 31 X |

OTHER PUBLICATIONS

Actron Mfg., Inc., 4 page brochure.
Southco fasteners, 1 page advertisement. 1978.
RV News, Sep. 1989, p. 34.
Austin Hardware, New Equipment Reporter, p. 11.
McMaster-Carr Supply Company, Latches, 2 page advertisement.

*Primary Examiner*—Rodney M. Lindsey
*Attorney, Agent, or Firm*—Harris, Wallen MacDermott & Tinsley

[57] ABSTRACT

A latch having a housing and a handle mounted in the housing for pivoting between a rest position and an unlatching position, a cam lever pivotally mounted in the housing for rotation by the handle about a first axis, a bolt drive slide mounted in the housing for translation along a second axis perpendicular to the first axis, a bolt mounted in the housing for translation along a third axis perpendicular to the second axis, and springs for the slide and the bolt, with the cam lever and bolt drive slide engaging for moving the slide and with the bolt drive slide and bolt engaging for moving the bolt when the handle is pivoted to the unlatching position.

15 Claims, 6 Drawing Sheets

FIG. 1
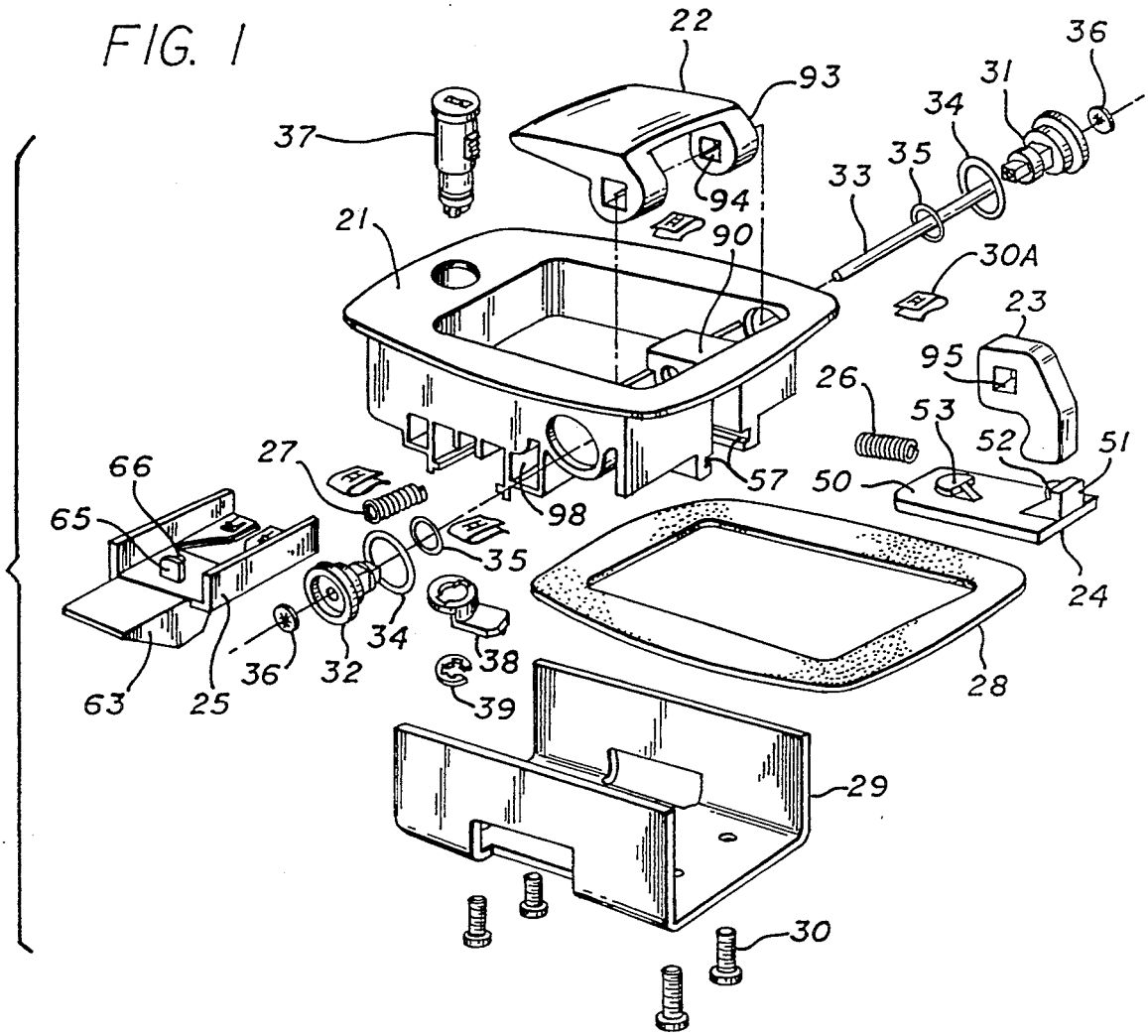
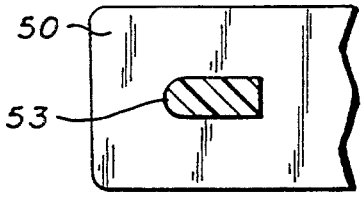
FIG. 7A
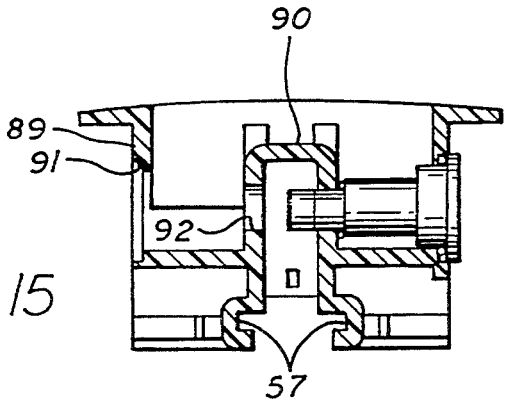
FIG. 15

FIG. 2
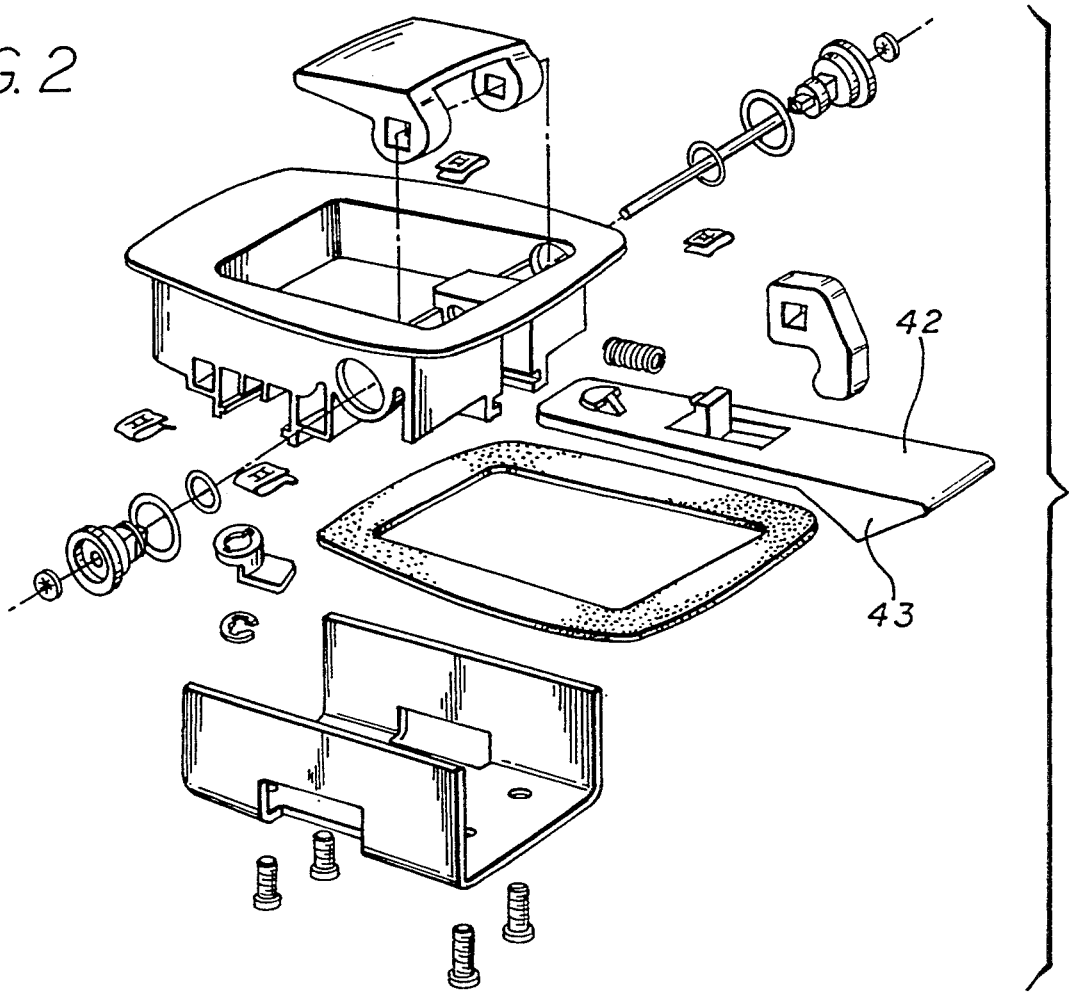
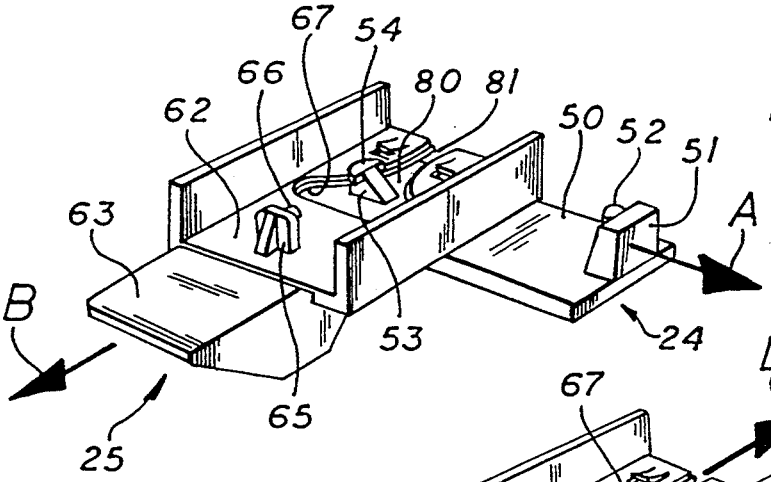
FIG. 7
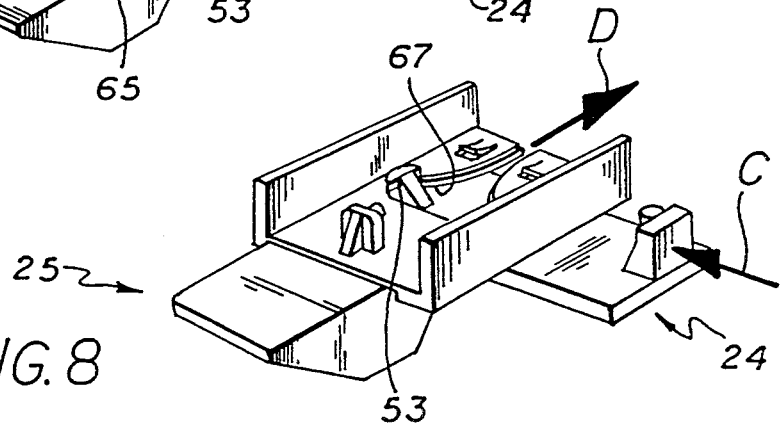
FIG. 8

SELF-CLOSING LATCH

BACKGROUND OF THE INVENTION

This invention relates to self-closing latches and in particular, to a new and improved latch suitable for use on motor vehicles, cabinet doors and the like, where it is desirable for the door to latch closed automatically.

Various forms of self-closing latches have been utilized in the past. These prior designs suffer from a variety of problems and it is an object of the present invention to provide a new and improved latch which will eliminate or overcome such disadvantages.

Most latches have the bolt positioned at a fixed location. When such latches are used on storage compartment doors of trucks or motor homes, they sometimes end up facing the wrong direction. It is generally desirable to have the handle pointing toward the rear of the vehicle or downward, so it does not catch on tree branches or other obstacles. In latch installations where the handle is pointing upward, the finger well can fill with mud or snow and ice, and cause the latch to become inoperative. Automobiles do not have this problem because the door latches are designed specifically for each model, but for trucks and other large vehicles, existing designs are purchased whenever possible.

Many of the latches being used today are either overdesigned or underdesigned for use on storage compartment doors. Some latches are intended for driver and passenger doors and are overweight because of the heavy duty all-metal construction that is required for strength. Other latches intended for simple interior cabinetry do not have the design integrity to handle the vibration and mechanical abuse that is present on a motor vehicle. In many presently available latches, the linkage mechanism for actuating the latch bolt and locking feature is too complex and requires a large number of components.

SUMMARY OF THE INVENTION

It is an object of the present invention to provide a new and improved latch which is self-closing, and one which can be locked and still be self-closing. It is another particular object of the invention to provide a latch with a bolt design which can be used for left or right hand operation and which can be mounted on a door or panel or the like in a variety of orientations. Another object of the invention is to provide a latch which can be substantially water-tight so that there is little or no water leakage through the latch structure. An additional object is to provide such a latch with a new and improved double-axle bushing for pivoting of the handle in the latch housing.

A further specific object of the invention is to provide a latch which remains latched even if the handle is broken, thereby preventing break-in by prying the handle.

It is a particular object of the invention to provide a latch which can be produced with a small number of parts, typically molded plastic parts, and assembled without special tools or jigs or fixtures. An additional object is to provide such a latch that is mounted in a simple rectangular cut-out and installed by the end user with a screwdriver. A further object is to provide a latch which has the strength necessary for the intended application, is lightweight, and can be chrome plated to look like metal.

Other objects, advantages, features and results will more fully appear in the course of the following description.

The presently preferred embodiment of the latch includes a housing and a handle mounted in the housing for pivoting between a rest position and an unlatching position, a cam lever pivotally mounted in the housing for rotation by the handle about a first axis, a bolt drive slide mounted in the housing for translation along a second axis perpendicular to the first axis, a bolt mounted in the housing for translation along a third axis perpendicular to the second axis, a slide spring mounted in the housing between the housing and bolt drive slide for urging the slide in a first direction, with the cam lever and bolt drive slide including first interengaging means for urging the slide in a direction opposite to the first direction when the handle is pivoted to the unlatching position, and a bolt spring mounted in the housing between the housing and bolt for urging the bolt in a second direction perpendicular to the first direction to a latching position, with the bolt drive slide and bolt including second interengaging means for urging the bolt in a direction opposite to the second direction to an unlatched position when the handle is pivoted to the unlatching position.

The preferred embodiment includes a bolt channel in the housing along the third axis for slidingly receiving the bolt, with the bolt channel being symmetrical for selectively receiving the bolt and bolt spring in each of two opposite orientations for right and left hand operation, with the second interengaging means includes a slide cam carried on the bolt drive slide and with the bolt including means defining a cam track for the slide cam, with the cam track having opposed symmetrical sections for selective engagement by the slide cam for right and left hand orientation of the bolt in the housing.

The preferred embodiment includes provisions for a lock mounted in the housing and a lock cam carried on the lock and rotatable between locked and unlocked positions, with the lock cam positioned to engage the bolt drive slide when in the locked position blocking translation of the slide, while permitting translation of the bolt.

The preferred embodiment further includes spaced ribs in the housing defining a first channel for sliding of the bolt and spaced transverse stops in the first channel, with the bolt including at least one resilient tab projecting into the first channel for engaging a stop limiting translation of the bolt, with the bolt being initially insertable from either direction into the channel past a stop by flexing of the tab, and spaced ribs in the housing defining a second channel with a transverse partition dividing the second channel into two sections for selectively receiving the bolt spring.

The preferred embodiment provides an essentially waterproof design with an axle carried in the housing for supporting the handle and cam lever, with the housing having first pivot means for the handle and second pivot means for the cam lever, with opposed first larger diameter openings in the first pivot means and opposed second smaller diameter openings in the second pivot means, with the axle having two axle parts for insertion into the housing from opposite sides, each axle part having four sections with a first section fitting in a larger diameter opening, a second section fitting in a handle drive opening, a third section fitting in a smaller diameter opening, and a fourth section fitting in a cam lever drive opening. When desired, a seal gasket can be placed on the first and third sections of each axle part.

BRIEF DESCRIPTION OF THE DRAWINGS

FIG. 1 is an exploded view of a latch incorporating the presently preferred embodiment of the invention;

FIG. 2 is a view similar to that of FIG. 1 illustrating an alternative embodiment of the invention;

FIGS. 7 and 8 are enlarged perspective views illustrating the operation of the bolt drive slide and bolt with the bolt in one orientation;

FIG. 7A is a partial sectional view of the bolt drive slide showing the slide cam below the cap;

FIG. 15 is a sectional view taken along the pivot axis of the axle parts;

DESCRIPTION OF THE PREFERRED EMBODIMENTS

Figure 3:
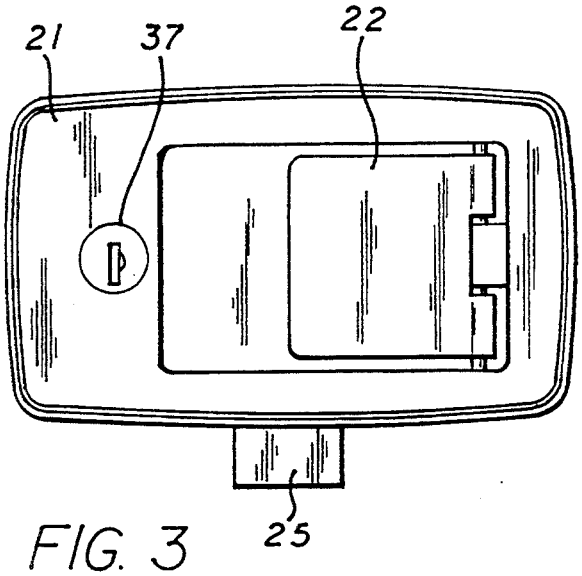
FIG. 3 is a top view of the latch of FIG. 1.

The latch as illustrated in FIG. 1 includes a housing 21, a handle 22, and cam lever 23, a bolt drive slide 24, a bolt 25, a slide spring 26, and a bolt spring 27.

The latch as illustrated also includes a mounting gasket 28, a mounting bracket or cover 29, four mounting screws 30 and four nut clips 30*a*.

The handle 22 and cam lever 23 are mounted in the housing on an axle which provides for rotation of the handle and cam lever relative to the housing. The axle includes axle parts 31, 32 carried on an axle shaft 33, with a larger seal gasket 34 and a smaller seal gasket 35 on each axle part. The axle parts are held on the shaft 33 by locking rings 36 at each end. In an alternative arrangement, the two axle parts may be constructed to engage each other at the inner ends, eliminating the need for the axle shaft and locking rings.

A conventional lock 37 may be mounted in the housing 21, with a lock cam 38 carried on the rotating section of the lock, and held in place by a lock snap ring 39.

The springs, gaskets, screws, nut clips, axle shaft and locking rings, and lock and lock snap ring may be conventional items readily available on the market. The other components of the latch typically are plastic moldings which may be assembled without any special tools, jigs or fixtures. The moldings may be lightweight and non-corrosive and may be produced in various finishes as desired. The substantial absence of metal parts makes the latch especially suitable where quantities of metal may be a problem, such as electronic installations and explosive hazardous situations.

The embodiment illustrated in FIG. 2 uses the components of the embodiment of FIG. 1, except for a different construction for the bolt slide 42 and omission of the bolt 25. A bolt end 43 is provided on the bolt slide 42, corresponding to the bolt end 63 of the bolt 25 of FIG. 1.

Figure 6:
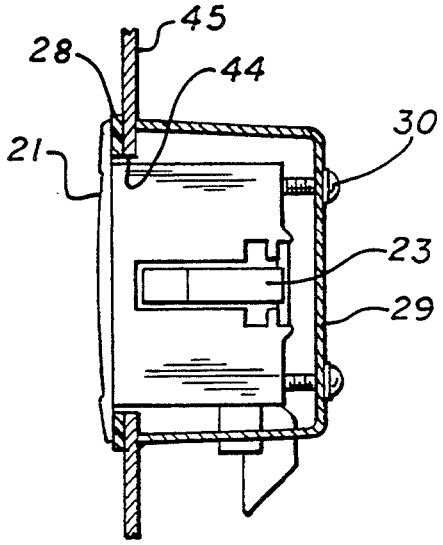
FIG. 6 is an end view of the latch of FIG. 1.
Figure 4:
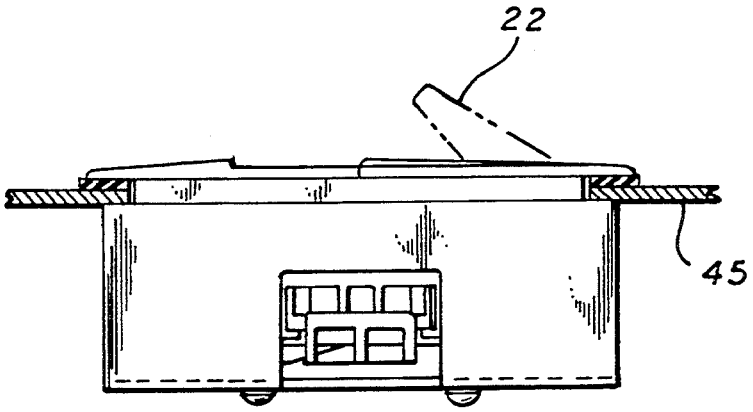
FIG. 4 is a side view of the latch of FIG. 1.

The latch may be installed in a simple rectangular opening 44 in a door panel or the like 45, with the housing 21 positioned in the opening from one side with the mounting bracket 29 positioned at the opening from the other side and attached to the housing by the screws 30, as best seen in FIGS. 4 and 6.

Figure 5:
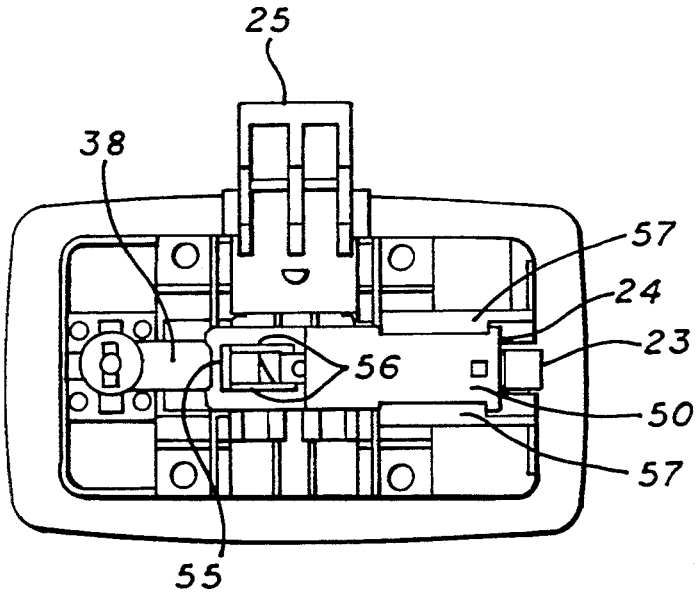
FIG. 5 is a bottom view of the latch of FIG. 1 with the mounting cover removed.

The bolt drive slide 24 is formed as a plate 50 with a bracket 51 at one end and a boss 52 projecting from the bracket. A slide cam 53 is carried adjacent the other end of the plate 50 (FIG. 7A). The slide cam preferably is semi-cylindrical in shape and has a cap 54 at the outer end. Another bracket 55 projects from the opposite end of the plate 50, preferably having side walls 56 (FIG. 5) . Spaced ribs 57 in the housing provide a channel for sliding of the bolt drive slide 24. The slide spring 26 is positioned in the housing between the ribs 57 and between a crossrib 58 with boss 59 of the housing and the bracket 51 with boss 52 of the slide plate. The bolt drive slide 24 and slide spring 26 are installed in the housing prior to assembling the axle, handle and cam lever. Then the cam lever retains the slide in place, with the spring urging the slide to the right as seen in FIG. 5 into engagement with the cam lever, with the curved end of the cam lever engaging the bracket 51 of the slide for translating the slide to the left as viewed in FIG. 5, when the handle 22 is raised to the position shown in phantom lines in FIG. 4.

The lock cam 38 is shown in the locked position in FIG. 5, with the cam engaging the bracket 55 of the bolt drive slide to prevent translation of the slide. When the lock is turned 90° to the unlocked position, the lock cam swings out of engagement with the slide bracket, permitting the slide to be translated by actuation of the handle 22. The side walls 56 of the bracket provide added strength for the bracket to resist attempts to open the latch when it is locked.

The bolt 25 has a central section 62 of a general channel shape, with a bolt end 63 projecting therefrom and supported with reinforcing ribs 64. A bracket 65 with a boss 66 projects from the central section. A cam track 67 is formed in the central section, with an undercut 68 therealong. One or more resilient tabs 69 are formed in the central section with the tabs projecting into the channel, as best seen in FIG. ?

Spaced ribs 71 and gibs 72 define a channel in the housing for sliding of the bolt 25. Typically, the crossrib 58 is part of one of the ribs 71. Spaced ribs 73 in the housing form another channel for receiving the bolt spring, with a crossrib 74 between the ribs 73 and with a boss 75 on each side of the crossribs 74. Bolt stops 77 are formed on the housing in the channel between the ribs 71, preferably with guides 78 between each pair of bolt stops 77.

The bolt is installed in the housing by placing the bolt spring 27 in a selected one of the channels formed by the ribs 73, with the spring ends over the bosses 66, 75. Then the bolt is pushed into the channel on the selected side. The resilient tabs 69 ride up over the bolt stops 77 along the transverse guides 78 and drop down after passing the second set of bolt stops. The bolt spring now urges the bolt to translate outward to the latched position, with engagement of the tabs 69 against the bolt stops 77 limiting this outward travel of the bolt.

The bolt cam track 67 is formed with a central opening 80 and an entry opening 81, which permits insertion of the bolt into the housing after the bolt drive slide 24 is installed, with the slide cam 53 passing through the entry opening 81 to the central opening 80 to engage the cam track, as seen in FIGS. 7 and 8. The slide spring 26 and the bolt spring 27 maintain the cam in engagement with the cam track.

The bolt drive slide and bolt are shown at rest in the latched position in FIG. 7, with the cam 53 engaging the cam track 67 adjacent the entry opening 81. The slide spring is urging the slide to the right in the direction of the arrow A and the bolt spring is urging the bolt to the left in the direction of the arrow B. Raising the handle applies a force to the slide 24 in the direction of the arrow C, compressing the slide spring 26, with the camming action of slide cam 53 and cam track 67 applying a force in the direction of the arrow D translating the bolt from the latched position to the unlatched position, against the urging of the bolt spring 27. When the handle is released, the slide and bolt return to the position of FIG. 7.

The open construction of the cam track of the bolt permits the cam track to be moved away from the cam of the slide 24 so that the bolt can be moved from the position of FIG. 7 to the position of FIG. 8 by closing the door on which the latch is mounted, without requiring any movement of the slide. This closing can be accomplished even when the slide is locked in place by the lock cam, thereby permitting closing of the door carrying the latch without requiring the key for the lock.

Figure 9:
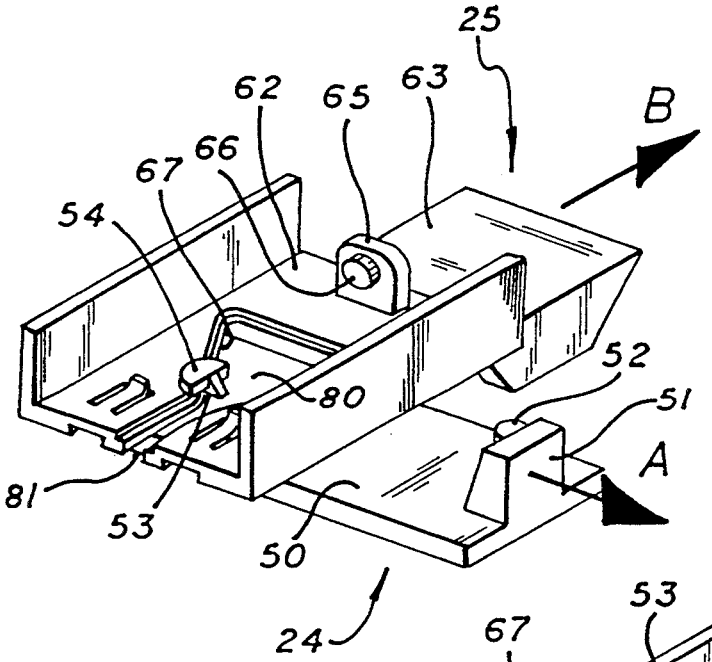
FIGS. 9 and 10 are views similar to FIGS. 7 and 8 illustrating the operation with the bolt in the opposite orientation.
Figure 10:
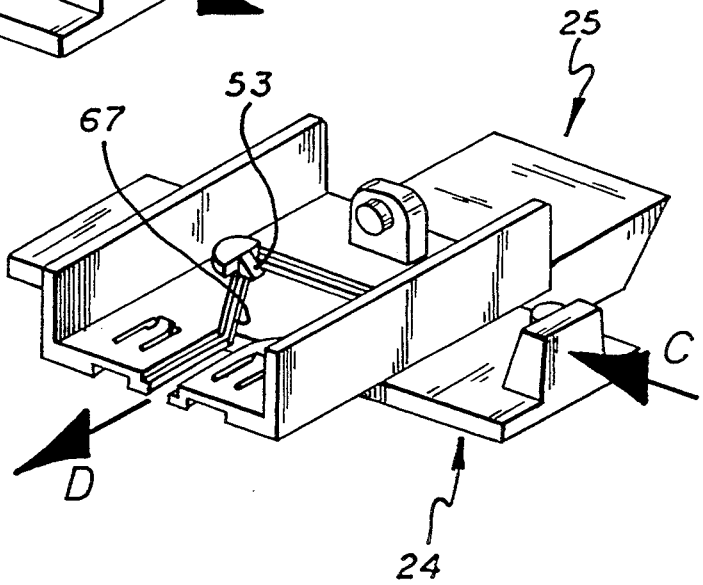

In the preferred embodiment, the housing and bolt are constructed symmetrically, thereby permitting the bolt to be inserted into the housing from either side, with the operation then being as shown in FIGS. 9 and 10. The cam track 67 has two sections 67a, 67b which are arranged perpendicular to each other so that the single bolt design can be used for both right and left hand latches.

Figure 11:
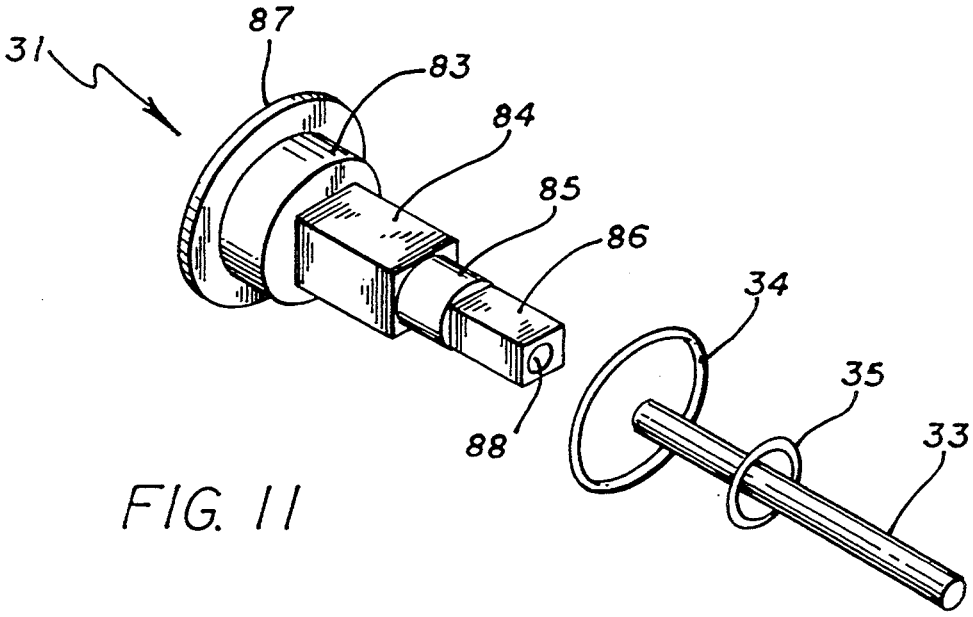
FIG. 11 is an enlarged view of one of the axle parts of the latch of FIG. 1.
Figure 12:
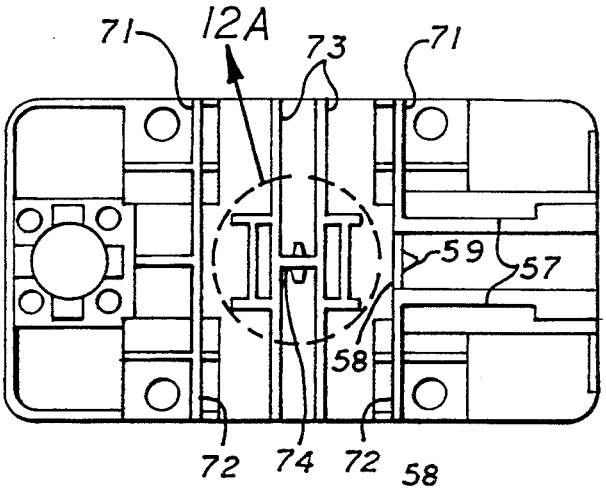
FIG. 12 is a view similar to that of FIG. 5 with the bolt drive slide and slide spring removed.
Figure 12A:
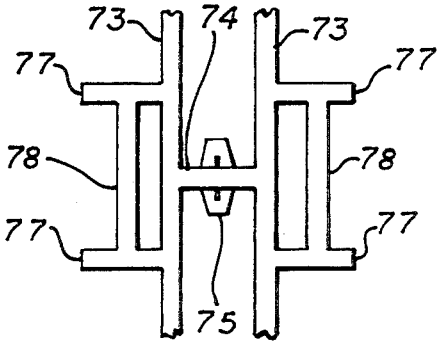
FIG. 12A is an enlarged view of the portion 12A of FIG. 12.
Figure 13:
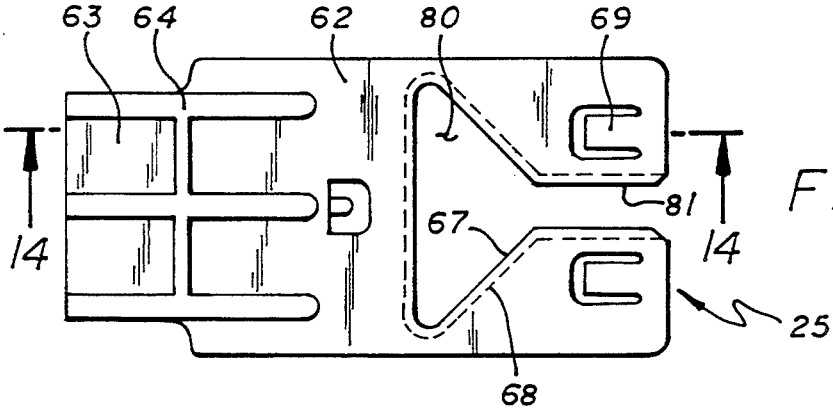
FIG. 13 is a plan view of the bolt 25.
Figure 14:
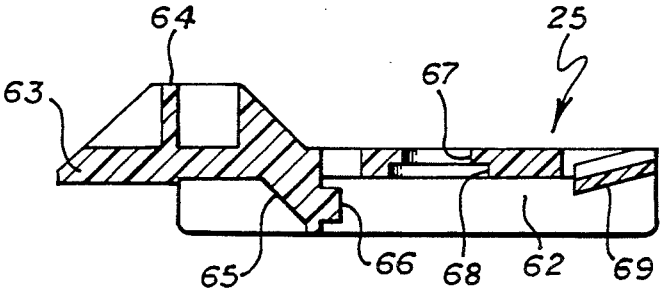
FIG. 14 is a sectional view taken along the line 14—14 of FIG. 13.

The presently preferred form for the axle part 31 is shown in greater detail in FIG. 11, with the axle part 32 being identical. The part has a larger diameter section 83, a handle section 84, a smaller diameter section 85, and a cam lever section 86. Preferably there is an outer flange 87 and a shaft opening 88 through the part. The axle parts are designed for fitting into the housing for rotation. The housing preferably has an outer cavity 89 and an inner inverted cavity 90 with aligned larger diameter openings 91 in the outer cavity walls and smaller diameter openings 92 in the inner cavity walls. The handle 22 has spaced brackets 93 with aligned non-round openings 94 therethrough, and the cam lever 23 has a non-round opening 95 therethrough. The handle sections 84 of the axle parts mate with the openings 94 of the handle and the cam lever sections 86 of the axle parts mate with the opening 95 of the cam lever.

The handle is positioned in the outer cavity of the housing with the handle brackets 93 straddling the inner cavity 90, and the cam lever is positioned in the inner cavity 90. Then the axle parts are pushed in from each side passing through the housing and handle openings and the cam lever opening. Typically, counterbores are provided on the outer sides of the housing walls for receiving the outer flanges 87 of the axle parts. The axle shaft is passed through the assembly and is fixed in place by the axle locking rings 36. With this construction, the latch is essentially splash tight. If improved water resistance is desired, the seal gaskets 34, 35 are installed along with the axle parts. Various other arrangements for joining the two axle parts can be utilized, including having the inner ends of the axle parts interlocking in some manner to avoid the use of the shaft.

The latch may be assembled at the factory by pushing the parts together, without utilizing any tools or the like. The latch may be shipped with the bolt and bolt spring separate so that the installer can insert the bolt in the desired orientation. This is another pushing operation without requiring tools.

For installation, the nut clips 30*a* are slid onto flanges 98 of the housing, the latch is positioned in the opening in the door panel, the mounting bracket is positioned on the other side of the panel around the latch, and the screws 30 are tightened into the nut clip 39*a*. The latch is now ready for use.

Figure 16:
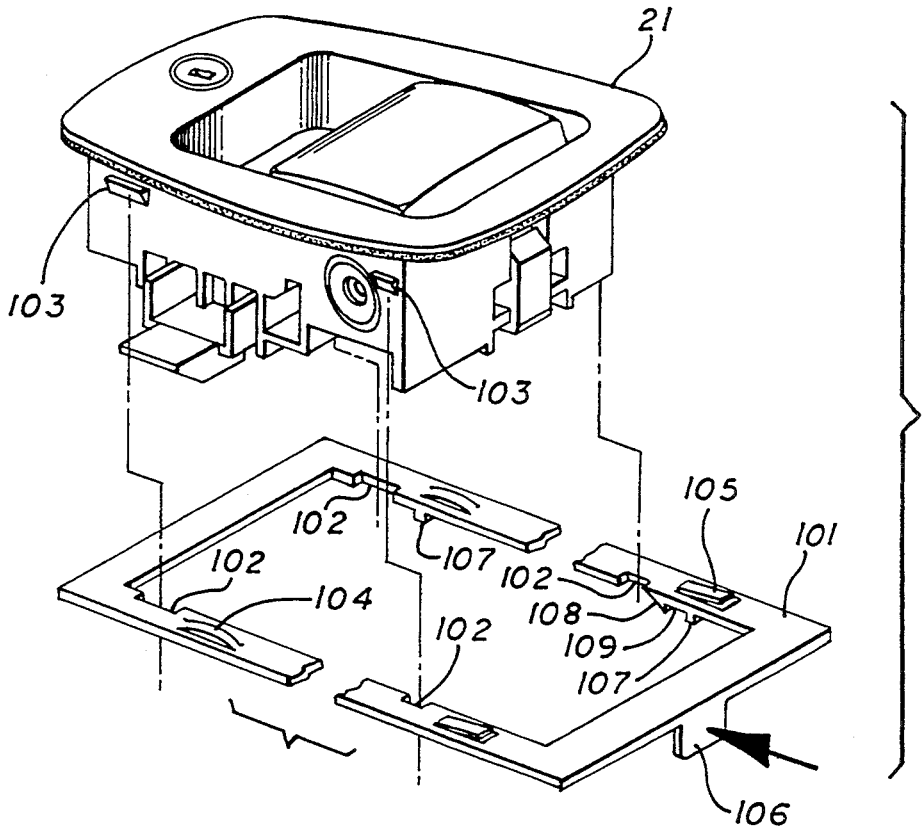
FIG. 16 is an exploded view similar to that of FIG. 1 showing an alternative mounting arrangement.
Figure 17:
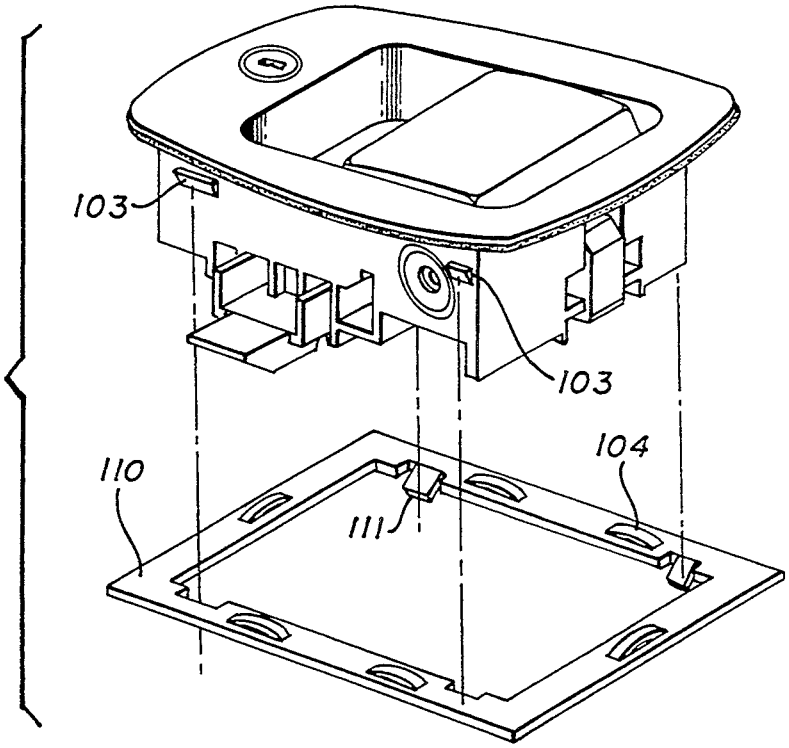
FIG. 17 is an exploded view like FIG. 16 showing another alternative mounting arrangement.

Alternative constructions for installing or mounting the latch are shown in FIGS. 16 and 17, with the mounting bracket or cover 29, mounting screws 30 and nut clips 30*a* omitted. A mounting plate 101 has an open center for receiving the housing 21 of the latch, with cut-outs 102 in the mounting plate providing clearance for outwardly projecting shoulders or tabs 103 on the housing. Raised sections 104, 105 are formed in the mounting plate 101. The raised sections may be arched as shown at 104, or may be cantilevered as shown at 105.

To install the latch, the housing with gasket is positioned in the opening in the door panel from one side, and the mounting plate 101 is positioned over the housing from the other side of the panel with the shoulders 103 passing through the cut-outs 102. The mounting plate is then pushed to the left as viewed in FIG. 16, typically by pushing on the tab 106. Stops 107 on the mounting plate limit the sliding motion. A ramp 108 and a seat 109 may be provided between the cut-out and the stop if desired for ease of installation. The raised sections 104, 105 provide pressure against the door panel so that the latch stays tight against the gasket.

An alternative mounting arrangement is shown in FIG. 17 with a mounting plate 110 having raised sections 104 and/or 105, and tabs 111 in place of the cut-outs 102. With this form of mounting plate, the shoulders 103 preferably have sloping bases.

With this embodiment the latch is installed by pushing the mounting plate 110 onto the housing with the gasket and door panel therebetween, in contrast to the embodiment of FIG. 16 where the mounting plate is slid into position. The tabs 111 are deflected downward as they slide up over the sloping base of the shoulders 103 when the mounting plate is pushed onto the housing. The tabs spring back into position on the upper surfaces of the shoulders 103 for retaining the latch in position on the door panel.

We claim:

1. In a latch having a housing and a handle mounted in said housing for pivoting between a rest position and an unlatching position, the improvement comprising in combination:

a cam lever pivotally mounted in said housing for rotation by said handle about a first axis;

a bolt drive slide mounted in said housing for translation along a second axis perpendicular to said first axis, with a slide cam carried thereon;

a bolt mounted in said housing for translation along a third axis perpendicular to said second axis, said bolt having a cam track for engagement with said slide cam, said cam track having opposed symmetrical surfaces selectively engageable with said cam for driving said bolt in opposite directions;

a slide spring mounted in said housing between said housing and bolt drive slide for urging said slide in a first direction, said cam lever and bolt drive slide including first interengaging means for urging said slide in a direction opposite to said first direction when said handle is pivoted to said unlatching position; and a bolt spring mounted in said housing between said housing and bolt for urging said bolt in a second direction perpendicular to said first direction to a latching position, said bolt drive slide and bolt including second interengaging means for urging said bolt in a direction opposite to said second direction to an unlatched position when said handle is pivoted to said unlatching position.

2. A latch as defined in claim 1 wherein said housing includes means defining a bolt channel along said third axis for slidingly receiving said bolt, with said bolt channel being symmetrical about said second axis for selectively receiving said bolt and bolt spring in each of two opposite orientations for right and left hand operation.

3. In a latch having a housing and a handle mounted in said housing for pivoting between a rest position and an unlatching position, the improvement comprising in combination:

a cam lever pivotally mounted in said housing for rotation by said handle about a first axis;

a bolt drive slide mounted in said housing for translation along a second axis perpendicular to said first axis, a bolt mounted in said housing for translation along a third axis perpendicular to said second axis;

a slide spring mounted in said housing between said housing and bolt drive slide for urging said slide in a first direction, said cam lever and bolt drive slide including first interengaging means for urging said slide in a direction opposite to said first direction when said handle is pivoted to said unlatching position; and a bolt spring mounted in said housing between said housing and bolt for urging said bolt in a second direction perpendicular to said first direction to a latching position, said bolt drive slide and bolt including second interengaging means for urging said bolt in a direction opposite to said second direction to an unlatched position when said handle is pivoted to said unlatching position, said second interengaging means including a slide cam carried on said bolt drive slide and said bolt includes means defining a cam track for said slide cam, said cam track having opposed sections symmetrical about said third axis for selective engagement by said slide cam for right and left hand orientation of said bolt in said housing.

said slide cam having a cap and said cam track is undercut for receiving said cap.

4. A latch as defined in claim 3 wherein said slide cam is semi-circular and said cam track opposed sections are perpendicular to each other.

5. A latch as defined in claim 1 including a lock mounted in said housing and a lock cam carried on said lock and rotatable between locked and unlocked positions, with said lock cam positioned to engage said bolt drive slide when in said locked position blocking translation of said slide.

6. A latch as defined in claim 5 wherein said bolt cam track is a surface for sliding engagement by said slide cam, with said cam track being movable away from said slide cam when said bolt is translated from a latched position toward said unlatched position against the urging of said bolt spring without movement of said bolt drive slide, permitting closing of said latch while locked.

7. A latch as defined in claim 1 wherein said bolt cam track is a surface for sliding engagement by said slide cam, with said cam track being movable away from said slide cam when said bolt is translated from a latched position toward said unlatched position against the urging of said bolt spring without movement of said bolt drive slide, permitting closing of said latch while locked.

8. In a latch having a housing and a handle mounted in said housing for pivoting between a rest position and an unlatching position, the improvement comprising in combination:

a cam lever pivotally mounted in said housing for rotation by said handle about a first axis;

a bolt drive slide mounted in said housing for translation along a second axis perpendicular to said first axis;

a bolt mounted in said housing for translation along a third axis perpendicular to said second axis;

a slide spring mounted in said housing between said housing and bolt drive slide for urging said slide in a first direction, said cam lever and bolt drive slide including first interengaging means for urging said slide in a direction opposite to said first direction when said handle, is pivoted to said unlatching position; and a bolt spring mounted in said housing between said housing and bolt for urging said bolt in a second direction perpendicular to said first direction to a latching position, said bolt drive slide and bolt including second interengaging means for urging said bolt in a direction opposite to said second direction to an unlatched position when said handle is pivoted to said unlatching position, said second interengaging means including a slide cam carried on said bolt drive slide and said bolt includes means defining a cam track for said slide cam, said cam track having opposed sections symmetrical about said third axis for selective engagement by said slide cam for right and left hand orientation of said bolt in said housing, said housing including spaced ribs defining a first channel for sliding of said bolt and further including spaced transverse stops in said first channel, and said bolt including at least one resilient tab projecting into said first channel for engaging a stop limiting translation of said bolt, with said bolt being initially insertable from either direction into said channel past a stop by flexing of said tab.

9. A latch as defined in claim 8 wherein said housing further includes spaced ribs defining a second channel with a transverse partition dividing said second channel into two sections for selectively receiving said bolt spring.

10. In a latch having a housing and a handle mounted in said housing for pivoting between a rest position and an unlatching position, the improvement comprising in combination:

a cam lever pivotally mounted in said housing for rotation by said handle about a first axis;

a bolt drive slide mounted in said housing for translation along a second axis perpendicular to said first axis;

a bolt mounted in said housing for translation along a third axis perpendicular to said second axis;

a slide spring mounted in said housing between said housing and bolt drive slide for urging said slide in a first direction, said cam lever and bolt drive slide including first interengaging means for urging said slide in a direction opposite to said first direction when said handle is pivoted to said unlatching position; and a bolt spring mounted in said housing between said housing and bolt for urging said bolt in a second direction perpendicular to said first direction to a latching position, said bolt drive slide and bolt including second interengaging means for urging said bolt in a direction opposite to said second direction to an unlatched position when said handle is pivoted to said unlatching position, said second interengaging means including a slide cam carried on said bolt drive slide and said bolt includes means defining a cam track for said slide cam, said cam track having opposed sections symmetrical about said third axis for selective engagement by said slide cam for right and left hand orientation of said bolt in said housing, said latch further including an axle carried in said housing for supporting said handle and said cam lever, said housing having first pivot means for said handle and second pivot means for said cam lever, with opposed first larger diameter openings in said first pivot means and opposed second smaller diameter openings in said second pivot means, said handle having spaced drive openings and said cam lever having a drive opening, said axle having two axle parts for insertion into said housing from opposite sides, each axle part having four sections with a first section fitting in said larger diameter opening in said first pivot means, a second section fitting in said handle drive opening, a third section fitting in said smaller diameter opening in said second pivot means, and a fourth section fitting in said cam lever drive opening.

11. A latch as defined in claim 10 including a seal gasket on said first section and said third section of each of said axle parts.

12. In a latch having a housing and a handle mounted in said housing for pivoting between a rest position and an unlatching position, the improvement comprising in combination:

a cam lever pivotally mounted in said housing for rotation by said handle about a first axis;

a bolt slide mounted in said housing for translation along a second axis perpendicular to said first axis;

a slide spring mounted in said housing between said housing and bolt slide for urging said slide in a first direction, said cam lever and bolt slide including first interengaging means for urging said slide in a direction opposite to said first direction when said handle is pivoted to said unlatching position; and an axle carried in said housing for supporting said handle and said cam lever, said housing having first pivot means for said handle and second pivot means for said cam lever, with opposed first larger diameter openings in said first pivot means and opposed second smaller diameter openings in said second pivot means, said handle having spaced drive openings and said cam lever having a drive opening, said axle having two axle parts for insertion into said housing from opposite sides, each axle part having four sections with a first section fitting in said larger diameter opening in said first pivot means, a second section fitting in said handle drive opening, a third section fitting in said smaller diameter opening in said second pivot means, and a fourth section fitting in said cam lever drive opening.

13. A latch as defined in claim 12 including:

a bolt mounted in said housing for translation along a third axis perpendicular to said second axis; and a bolt spring mounted in said housing between said housing and bolt for urging said bolt in a second direction perpendicular to said first direction to a latching position, said bolt slide and bolt including second interengaging means for urging said bolt in a direction opposite to said second direction to an unlatched position when said handle is pivoted to said unlatching position.

14. A latch as defined in claim 13 wherein said housing includes means defining a bolt channel along said third axis for slidingly receiving said bolt, with said bolt channel being symmetrical about said second axis for selectively receiving said bolt and bolt spring in each of two opposite orientations for right and left hand operation.

15. A latch as defined in claim 12 wherein said bolt slide includes a bolt at one end thereof.

* * * * *